US005228326A

United States Patent [19]

Wasilko et al.

[11] Patent Number: 5,228,326

[45] Date of Patent: Jul. 20, 1993

[54] CRIMP HEIGHT ADJUSTMENT MECHANISM

[75] Inventors: John M. Wasilko; Richard O. Wilson, both of Harrisburg, Pa.

[73] Assignee: The Whitaker Corporation, Wilmington, Del.

[21] Appl. No.: 15,750

[22] Filed: Feb. 9, 1993

[51] Int. Cl.[5] ..... H01R 43/04

[52] U.S. Cl. ..... 72/446; 72/413; 29/753; 29/863

[58] Field of Search ..... 29/705, 720, 748, 753, 29/863; 72/446, 413, 466, 451; 81/398

[56] References Cited

U.S. PATENT DOCUMENTS

| | | | |
|---|---|---|---|
| 2,691,911 | 10/1954 | Gren | 81/398 |
| 3,051,213 | 8/1962 | Batcheller | 72/413 |
| 3,091,276 | 5/1963 | Aquillon | 29/753 |
| 3,335,599 | 8/1967 | Balsam | 72/413 |
| 4,856,186 | 8/1989 | Yeomans | 29/863 |
| 4,916,810 | 4/1990 | Yeomans | 29/863 |
| 5,040,288 | 8/1991 | Nilsson | 29/753 |
| 5,046,241 | 9/1991 | Ricard | 29/863 |

*Primary Examiner*—David Jones
*Attorney, Agent, or Firm*—Robert J. Kapalka

[57] ABSTRACT

A crimp height adjustment mechanism is disclosed for use in a crimping machine having an anvil and a ram carrying a crimping die. The ram is secured against rotation and guided for reciprocal movement along a ram axis for moving the crimping die toward and away from the anvil. A drive member is connected for reciprocating the ram. The adjustment mechanism includes a first member fixed with respect to the anvil and having a first threaded portion of a first thread pitch extending along an adjustment axis parallel to the ram axis. A second member has a second threaded portion coaxial to the first threaded portion. The second threaded portion has a second thread pitch which differs from the first thread pitch. The second member is secured against rotation and coupled to move the ram linearly along the ram axis. A third member has both a third threaded portion which is threadedly engaged with the first threaded portion, and a fourth threaded portion which is threadedly engaged with the second threaded portion. The third member is rotatable about the adjustment axis so as to change an extent of engagement with the first and second threaded portions. Rotation of the third member about the adjustment axis produces a linear movement of the second member which is equal to a number of rotations of the third member multiplied by a difference between the first and second pitches.

13 Claims, 5 Drawing Sheets

CRIMP HEIGHT ADJUSTMENT MECHANISM

BACKGROUND OF THE INVENTION

1. Field of the Invention

The invention relates to a machine for crimping a terminal to an electrical conductor, and more particularly, to a mechanism which enables extremely fine adjustment of the height of a crimped terminal produced in such a machine.

2. Prior Art

Machines are known for crimping a terminal to an electrical conductor such as a wire or cable. Such machines generally employ a ram which is reciprocally movable with respect to a fixed anvil. The ram carries a crimping die which cooperates with the anvil to crimp a terminal therebetween. In a crimping operation, the ram is driven through a working stroke to deform the terminal and tightly engage the conductor within the terminal to form a crimped connection.

The crimp height, i.e., the height or vertical dimension of the terminal after deformation, is a good indicator of quality of the crimped connection. In order to produce a secure and reliable crimped connection, the terminal must be deformed around the conductor until the height of the terminal is below a certain maximum. Terminals and conductors come in a variety of types and sizes, and the maximum is predetermined for many different combinations of terminals and conductors. Based on pullout tests which measure the tension required to separate crimped terminals of various crimp heights from their associated conductors, the maximum crimp height for a particular combination of terminal and conductor can be calculated. Ideal crimp heights are somewhat below the maximum so as to provide a safety factor against pullout while avoiding excessive deformation of the terminal which may in itself destroy the crimped connection and requires greater energy to produce.

A crimping machine which has been set up to produce a certain crimp height may require adjustment after some time in operation. The need for adjustment may be due to wear of components in the machine, non-uniformity of terminals being crimped, or a change in the type or size of the terminal or conductor. Various mechanisms for adjusting crimp height are known. These mechanisms provide either a means to vary the working stroke of the ram or a means to adjust a rest position of the ram with respect to the anvil, thereby adjusting a dimension from the crimping die to the anvil when the ram is at the fullest extent of its working stroke. The known adjustment mechanisms are somewhat coarse, generally being unable to achieve crimp height adjustments in increments smaller than 0.001 inch.

There is a need for a mechanism that provides extremely fine crimp height adjustments and that is easy to set to a desired value.

SUMMARY OF THE INVENTION

It is an object of the invention to provide a mechanism that enables crimp height to be adjusted in fine amounts.

It is another object of the invention to provide a crimp height adjustment mechanism that is simple to use.

It is a further object of the invention to provide a crimp height adjustment mechanism that is accurate and repeatable.

These and other objects are accomplished by the present invention in use on a standard crimping machine having an anvil and a ram carrying a crimping die which cooperates with the anvil to crimp a terminal disposed therebetween. The ram of the crimping machine is secured against rotation and guided for reciprocal movement along a ram axis for moving the crimping die toward and away from the anvil between remote and proximate positions with respect to the anvil. A drive member is connected for reciprocating the ram, and the crimping die cooperates with the anvil to crimp the terminal when the crimping die is in the proximate position. The adjustment mechanism of the present invention includes a hub fixed with respect to the anvil. The hub has a first threaded portion having a first thread pitch extending along an adjustment axis parallel to the ram axis. A yoke shaft has a second threaded portion that is coaxial to the first threaded portion. The second threaded portion has a second thread pitch which differs from the first thread pitch. The yoke shaft is secured against rotation and coupled to the ram such that linear movement of the yoke shaft along the adjustment axis produces a corresponding linear movement of the ram along the ram axis. An adjuster shaft has both a third threaded portion which is adjustably threadedly engaged with the first threaded portion, and a fourth threaded portion which is adjustably threadedly engaged with the second threaded portion. The adjuster shaft is rotatable about the adjustment axis via an actuation means so as to change an extent of engagement with the first and second threaded portions. As the adjuster shaft is rotated it moves linearly along the adjustment axis due a change in threaded engagement with the fixed hub. Simultaneously, the adjuster shaft undergoes a change in threaded engagement with the yoke shaft. Since the yoke shaft is threaded at a different pitch than the hub, rotation of the adjuster shaft produces a linear movement of the yoke shaft which is equal to a number of rotations of the adjuster shaft multiplied by a difference between the first and second pitches. The first and second pitches are preselected to have a pitch difference that is quite small, thereby providing a small and precisely controllable linear movement of the yoke shaft, which is coupled to the ram, due to the rotation of the adjuster shaft.

BRIEF DESCRIPTION OF THE DRAWINGS

There are shown in the drawings the embodiments of the invention that are presently preferred. It should be understood, however, that the invention is not limited to the precise arrangements and instrumentalities shown in the drawings, wherein:

FIG. 6 is an exploded isometric view of the crimp height adjustment mechanism shown in FIG. 4.

DETAILED DESCRIPTION OF THE PREFERRED EMBODIMENT

Figure 1:
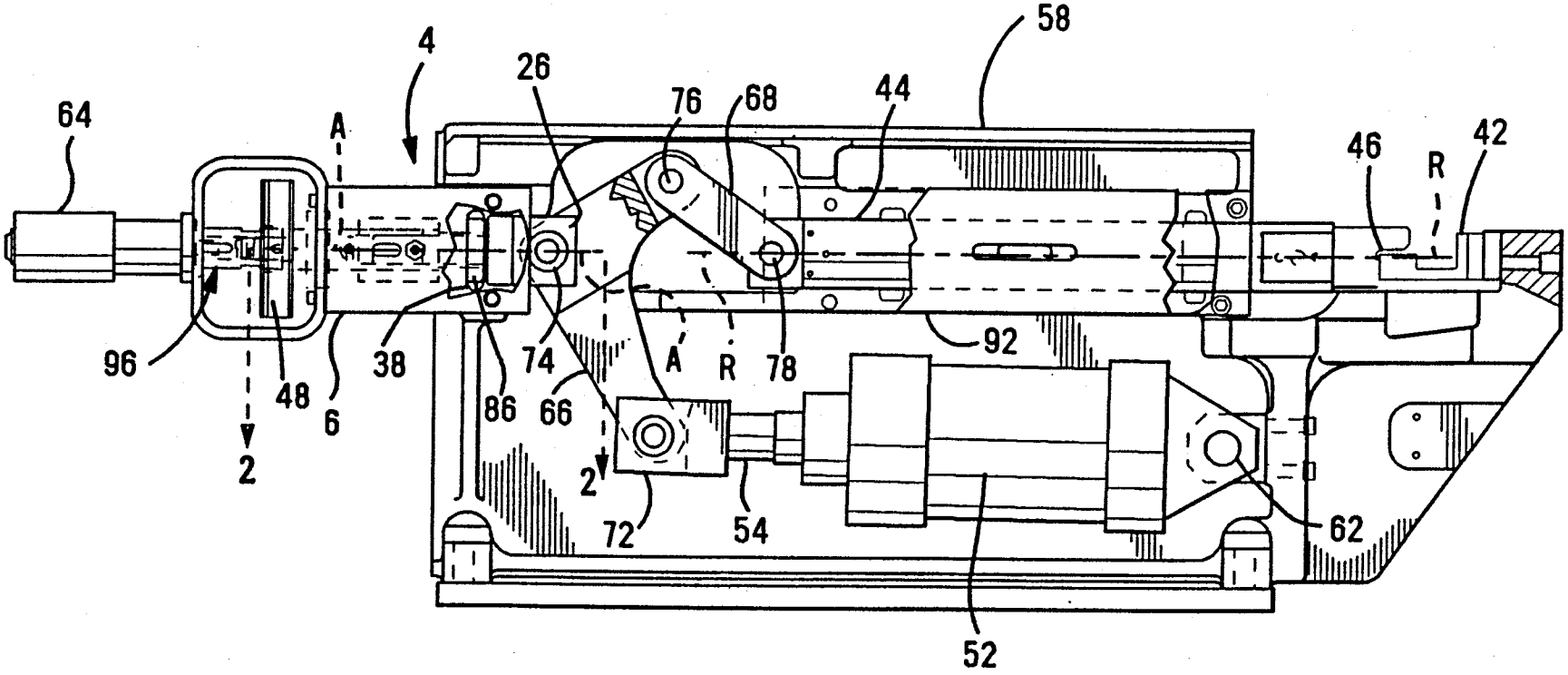
FIG. 1 is a side view of a crimping machine having a crimp height adjustment mechanism according to the invention.

With reference to FIG. 1, a crimp height adjustment mechanism according to the invention is shown generally as 4 in use on a crimping machine having a frame 58 which supports an anvil 42 and a ram 44 carrying a crimping die 46 at one end. The ram is guided for reciprocal movement along a ram axis R—R for moving the crimping die toward and away from the anvil between remote and proximate positions with respect to the anvil. As shown in the drawings, the ram has a rectangular cross-section and is disposed in a ramway of guideframe 92 of the machine frame 58. The guideframe 92 ramway guides the ram during its reciprocal movement and also secures the ram against rotation about the axis R—R. Of course, other arrangements for securing and guiding the ram will be readily apparent to those skilled in the art, and the crimp height adjustment mechanism of the present invention is equally well-suited for use with others of those arrangements.

The crimping machine further includes a drive member such as extensible cylinder 52 which is connected via bellcrank 66 and toggle link 68 for reciprocating the ram 44 and moving the crimping die 46 between the remote and proximate positions. The extensible cylinder 52 is operable via air or hydraulic forces received through connections (not shown) to extend or retract cylinder rod 54. One end of the cylinder 52 is connected by pivot pin 62 to the machine frame 58. The rod 54 is pivotally connected by clevis 72 with the bellcrank 66, which in turn has a pivotal connection 74 with the adjustment mechanism 4. The pivotal connection 74, which acts as a fulcrum for the bellcrank 66, is generally fixedly disposed during stroking of the cylinder 52, being linearly movable only during occasions of crimp height adjustment between strokes of the cylinder 52. The toggle link 68 has pivotal connections 76, 78 with the bellcrank 66 and the ram 44, respectively, thus completing a connection for reciprocating the ram 44 upon actuation of the cylinder 52. As with the guideframe 92 for securing and guiding the ram, other types of drive members and other arrangements for connecting a drive member to reciprocate the ram will be readily apparent to those skilled in the art and are considered to be within the scope of the invention.

The crimping die 46 is adapted to cooperate with the anvil 42 to crimp a terminal (not shown) onto a conductor when the crimping die is in the proximate position.

As shown in FIGS. 1-6, the crimp height adjustment mechanism 4 of the present invention is housed in a retainer 6 which is attached to the machine frame 58 by retainer key 86 extending through slot 38 in the retainer 6.

Figure 2:
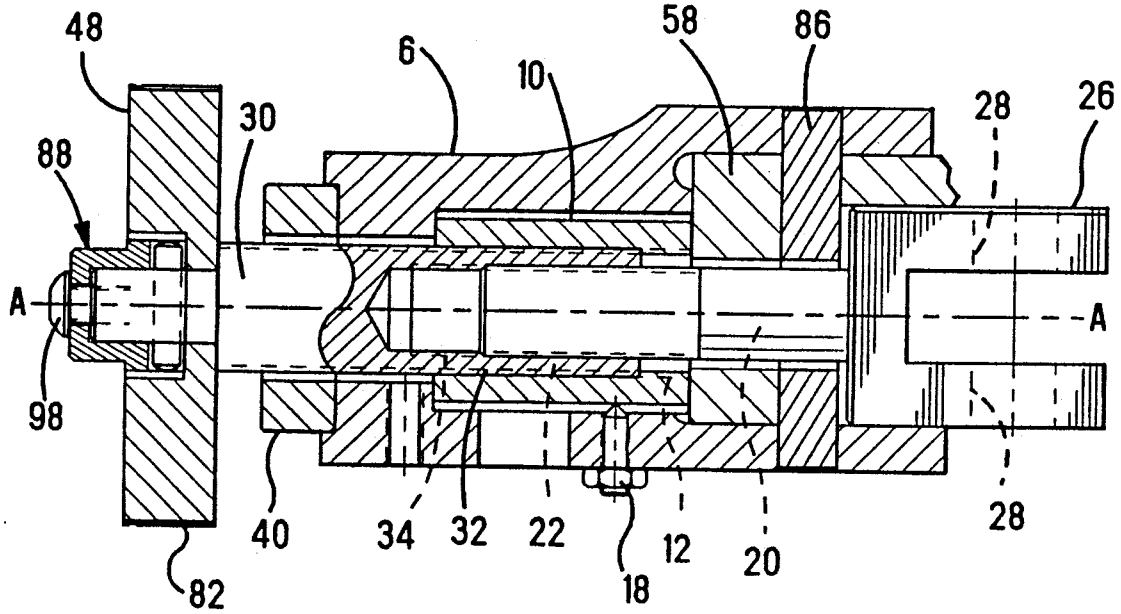
FIG. 2 is a cross-sectional view of the crimp height adjustment mechanism according to the invention, taken along line of FIG. 1.
Figure 3:
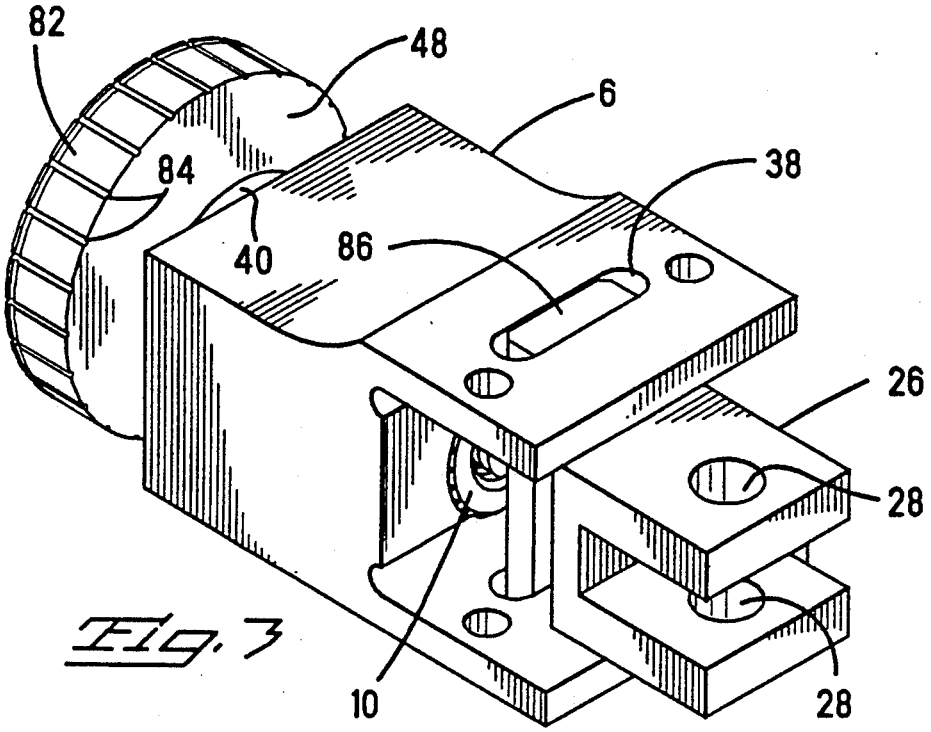
FIG. 3 is an isometric view of the crimp height adjustment mechanism.
Figure 4:
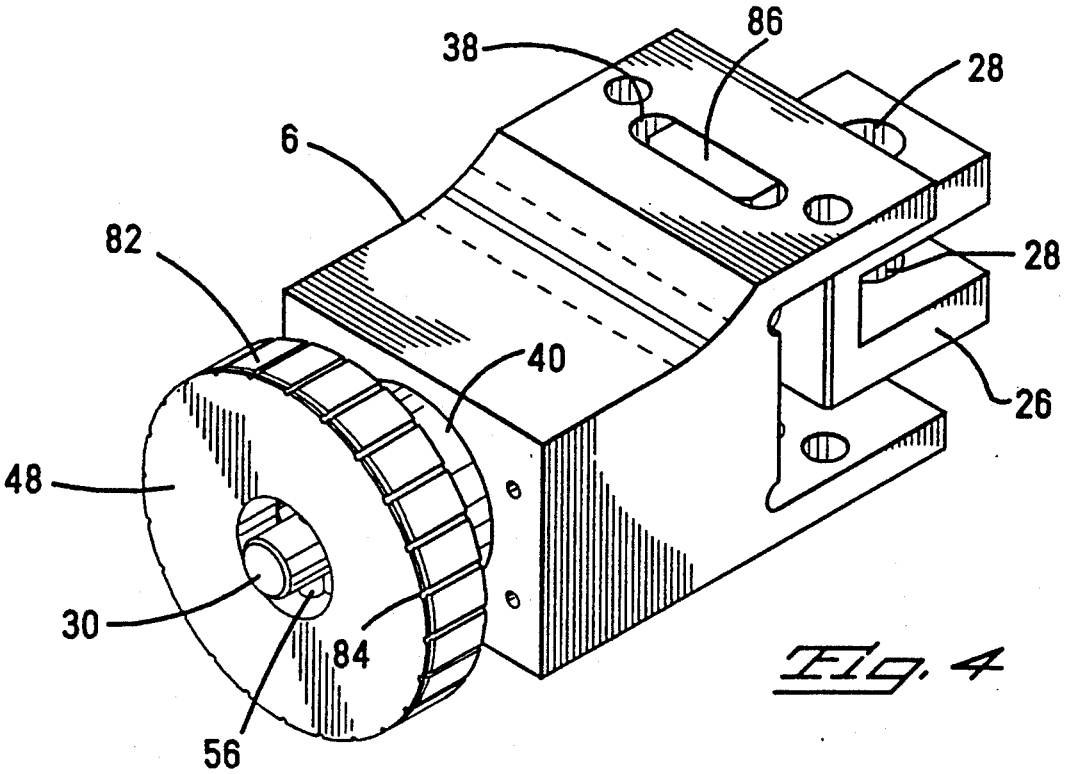
FIG. 4 is an isometric view of the crimp height adjustment mechanism, as viewed from a different direction.
Figure 5:
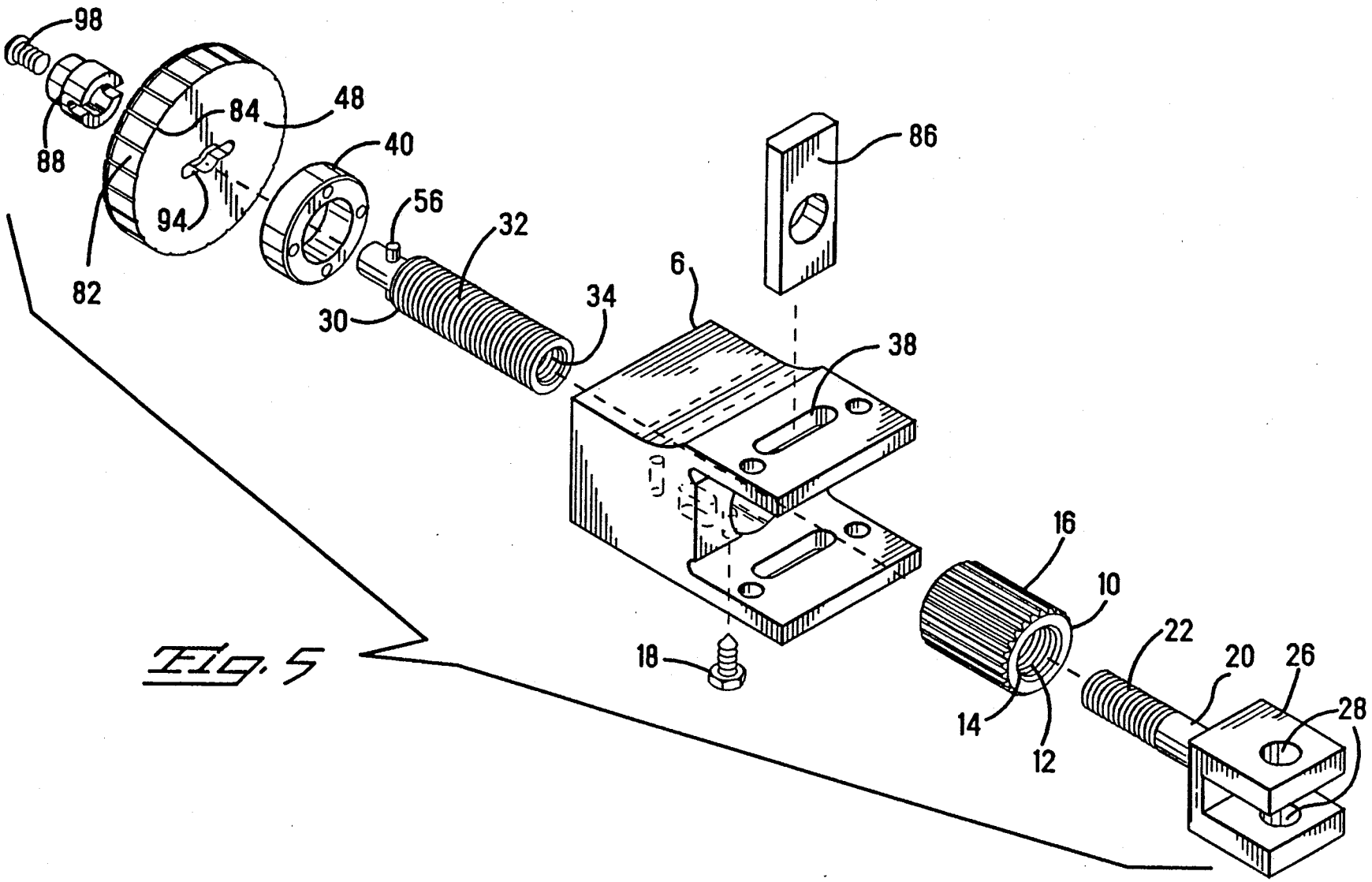
FIG. 5 is an exploded isometric view of the crimp height adjustment mechanism shown in FIG. 3.
Figure 5:
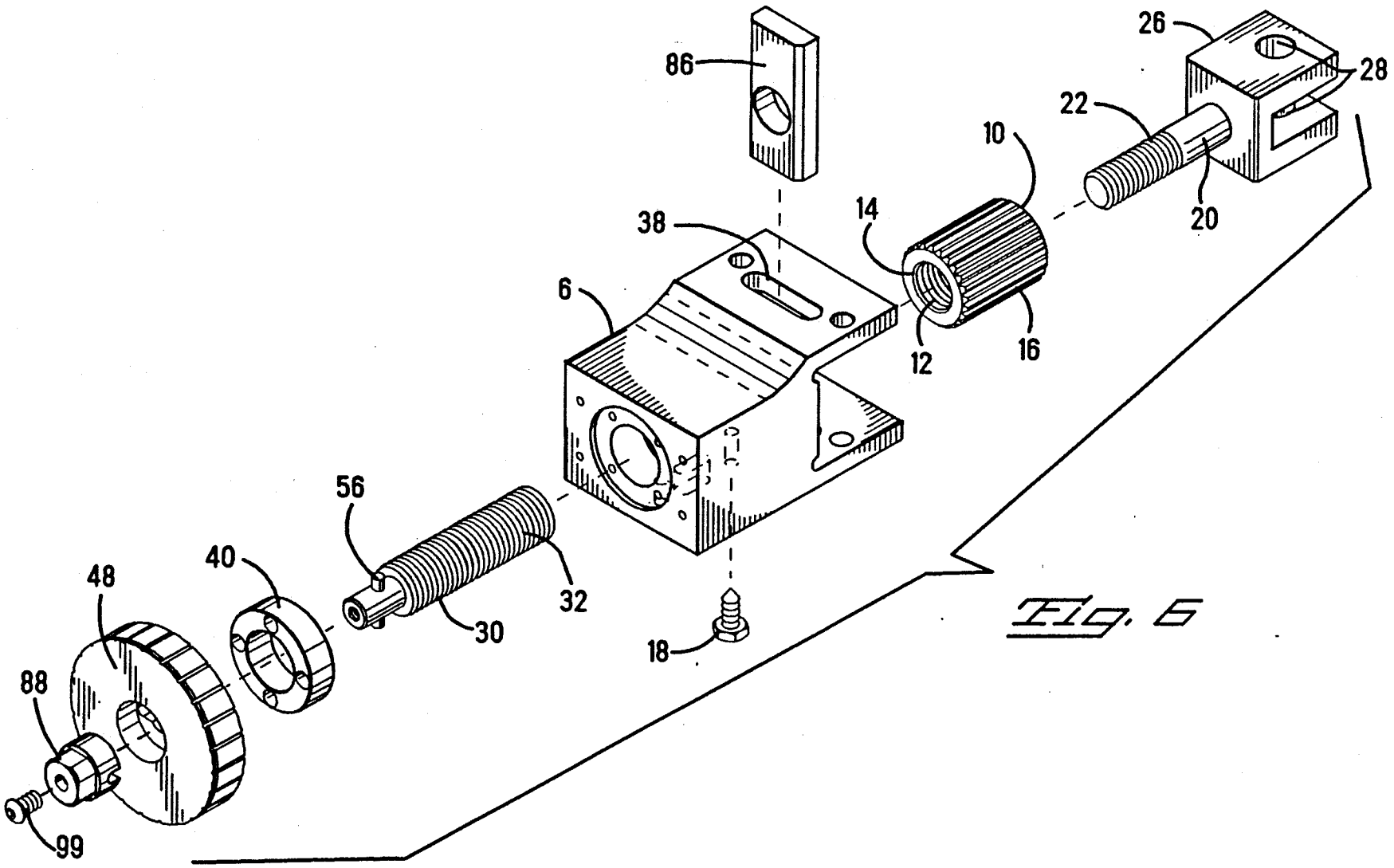

Referring now to FIGS. 2, 5 and 6, a first member 10 comprises a hub that is fixed within the retainer 6. The hub 10 has longitudinal splines 16 around its outer periphery, and a setscrew 18 threaded in the retainer 6 engages between two of the splines 16 and prevents rotation of the hub within the retainer. The hub 10 has a central bore 14 extending along an adjustment axis A—A which is parallel to the ram axis R—R. A wall of the central bore 14 defines screw threads which provide a first threaded portion 12 having a first thread pitch which is preselected as will be more fully described hereinafter.

In a preferred embodiment as shown in FIG. 1, the adjustment axis A—A of the adjustment mechanism 4 is coincident with the ram axis R—R.

Referring now to FIGS. 1, 2, 5 and 6, a second member 20 comprises a yoke shaft having a yoke 26 at one end which receives the pivotal connection 74 within holes 28 for joining with the bellcrank 66. The yoke shaft 20 is secured against rotation about the adjustment axis A—A by engagement of the yoke 26 in the guideframe 92 ramway. An other end of the yoke shaft 20 is threaded so as to define a second threaded portion 22 which is coaxial to the first threaded portion 12. The second threaded portion 22 has a second thread pitch which is selected to be different from the first thread pitch. The yoke shaft 20 is coupled to the ram 44 through the bellcrank 66 and the toggle link 68 such that linear movement of the second member 20 along the adjustment axis A—A produces a corresponding linear movement of the ram along the ram axis R—R.

A third member 30 comprises an adjuster shaft having an external periphery and a coaxial bore. The external periphery defines a third threaded portion 32 which is threadedly engaged with the first threaded portion 12 of the hub 10. The wall of the coaxial bore defines a fourth threaded portion 34 which is threadedly engaged with the second threaded portion 22 of the yoke shaft 20. In each instance the threaded engagement is loosely adjustable, i.e., the adjuster shaft 30 is rotatable about the adjustment axis A—A within the hub 10 and on the yoke shaft 20. Rotation of the adjuster shaft 30 causes an increase or decrease in the extent of engagement with the first threaded portion 12 and the second threaded portion 22. In the preferred embodiment, each of the first, second, third and fourth threaded portions comprises right hand screw threads, i.e., clockwise rotation of the adjuster shaft produces forward movement thereof. From the viewpoint of an observer at the left hand side of FIG. 2, clockwise rotation of the adjuster shaft 30 results in increasing engagement between the first threaded portion 12 and the third threaded portion 32. Thus, one rotation of the adjuster shaft 30 results in linear movement of the adjuster shaft to the right over a distance equal to the first thread pitch. Simultaneously, the fourth threaded portion 34 increasingly engages with the second threaded portion 22. However, since the second thread pitch has been selected to be different from the first thread pitch, one rotation of the adjuster shaft 30 results in linear movement of the yoke shaft 20 over a distance equal to the difference between the first and second pitches. When the first thread pitch 12 is greater than the second thread pitch 22, clockwise rotation of the adjuster shaft 30 results in right hand movement of the yoke shaft 20. Conversely, counterclockwise rotation of the adjuster shaft 30 results in left hand movement of the yoke shaft 20. The first and second pitches are selected so that a difference between them is quite small.

Actuation means enabling rotatable movement of the adjuster shaft 30 includes a manually gripable adjustment wheel 48. The wheel 48 has a groove 94 which allows passage for a drive pin 56 coupled to the adjuster shaft 30 which engages with a cap 88 or a motor coupler 96 and is secured with screw 98 for rotating the adjuster shaft. A stop collar 40 attached by threaded fasteners (not shown) to the retainer 6 limits axial movement of the adjustment wheel 48.

Figure 7:
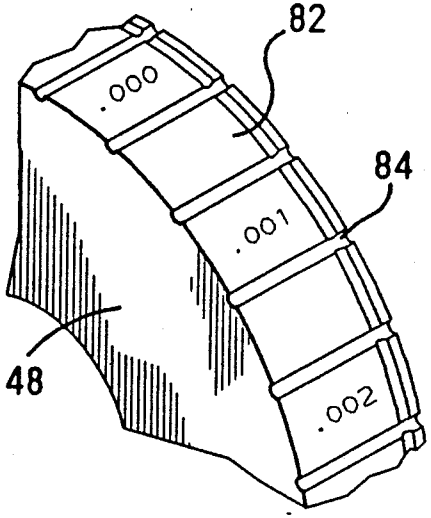
FIG. 7 is an isometric partial view of a manual adjustment wheel for the crimp height adjustment mechanism.

Preferably, circumferential surface 82 of the adjustment wheel 48 has alignment marks 84 at regular intervals, as shown in FIG. 7. By successively aligning the marks 84 with a fixed indicator on the adjustment apparatus 4, the adjuster shaft 30 can be rotated in precise steps in order to effect precise changes in crimp height.

In an embodiment of the crimp height adjustment mechanism preferred by applicants, the first thread pitch is 14 threads per inch (0.0714 inch) and the second thread pitch is 18 threads per inch (0.0555 inch). The difference between the first and second pitches is approximately 0.016 inch. The surface 82 of the adjustment wheel 48 has 32 of the marks 84 spaced at regular intervals 11.25 degrees apart around the circumference thereof. It is very easy to rotate the adjustment wheel 48 through an interval of 11.25 degrees to change alignment from one mark 84 to the next. Such a rotation of the adjustment wheel effects a change in crimp height of 0.0005 inch, with more precision and repeatability than prior devices for changing crimp height.

The actuation means may also include, either in addition to or in place of the adjustment wheel 48, an automatic means such as adjuster motor 64, shown in FIG. 1, which is connected for rotating the adjuster shaft 30 in response to a signal from a sensor (not shown). For example, the adjuster motor 64 can be electrically connected to a crimp height monitor such as that disclosed in U.S. Pat. No. 4,856,186 or U.S. Pat. No. 4,916,810, both of which are incorporated by reference as if fully set forth herein. The motor 64 can be programmed to make automatic crimp height adjustments when the crimp height monitor detects crimps that are out of specification. Further, the adjuster motor can be programmed to make a sequence of adjustments in order to perform a sequence of crimping operations requiring different crimp heights.

As shown in FIG. 2, it is preferred that the first, second, third and fourth threaded portions 12, 22, 32 and 34, respectively, be at least partly concentric in order to provide a compact arrangement for the crimp height adjustment mechanism.

The invention having been disclosed, a number of variations will now become apparent to those skilled in the art. Whereas the invention is intended to encompass the foregoing preferred embodiments as well as a reasonable range of equivalents, reference should be made to the appended claims rather that the foregoing discussion of examples, in order to assess the scope of the invention in which exclusive rights are claimed.

We claim:

1. A crimp height adjustment mechanism for use in a crimping machine having an anvil and a ram carrying a crimping die, the ram being secured against rotation and guided for reciprocal movement along a ram axis for moving the crimping die toward and away from the anvil between remote and proximate positions with respect to the anvil, the crimping die being adapted to cooperate with the anvil for crimping a terminal when the crimping die is in the proximate position, and a drive member connected for reciprocating the ram, the adjustment mechanism comprising:

a first member fixed with respect to the anvil and having a first threaded portion extending along an adjustment axis parallel to the ram axis, the first threaded portion having a first thread pitch;

a second member having a second threaded portion which is coaxial to the first threaded portion, the second threaded portion having a second thread pitch which differs from the first thread pitch, the second member being secured against rotation and coupled to the ram such that linear movement of the second member along the adjustment axis produces a corresponding linear movement of the ram along the ram axis;

a third member having both a third threaded portion which is adjustably threadedly engaged with the first threaded portion, and a fourth threaded portion which is adjustably threadedly engaged with the second threaded portion, the third member being rotatable about the adjustment axis so as to change an extent of engagement with the first and second threaded portions, the third member having actuation means enabling adjustable movement thereof;

wherein actuating rotation of the third member about the adjustment axis produces a linear movement of the second member which is equal to a number of rotations of the third member multiplied by a difference between the first and second pitches.

2. The adjustment mechanism according to claim 1, wherein the actuation means includes a manually gripable adjustment wheel fixed to the third member.

3. The adjustment mechanism according to claim 1, wherein the actuation means includes automatic means for performing the rotation in response to a signal from a sensor.

4. The adjustment mechanism according to claim 1, wherein the adjustment axis is coincident with the ram axis.

5. The adjustment mechanism according to claim 1, wherein the third member includes an elongated shaft having a coaxial bore, the third threaded portion is defined by an external periphery of the shaft, and the fourth threaded portion is defined by a wall of the bore.

6. The adjustment mechanism according to claim 5, wherein the first, second, third and fourth threaded portions are at least partly concentric.

7. A machine for crimping a terminal to an electrical conductor, comprising:

an anvil;

a ram carrying a crimping die, the ram being secured against rotation and guided for reciprocal movement along a ram axis for moving the crimping die toward and away from the anvil between remote and proximate positions with respect to the anvil, the crimping die being adapted to cooperate with the anvil for crimping the terminal when the crimping die is in the proximate position:

a drive member connected for reciprocating the ram; and, an adjustment mechanism for adjusting the proximate position of the crimping with respect to the anvil, the adjustment mechanism including:

a first member fixed with respect to the anvil and having a first threaded portion extending along an adjustment axis parallel to the ram axis, the first threaded portion having a first thread pitch;

a second member having a second threaded portion which is coaxial to the first threaded portion, the second threaded portion having a second thread pitch which differs from the first thread pitch, the second member being secured against rotation and coupled to the ram such that linear movement of the second member along the adjustment axis produces a corresponding linear movement of the ram along the ram axis;

a third member having both a third threaded portion which is adjustably threadedly engaged with the first threaded portion, and a fourth threaded portion which is adjustably threadedly engaged with the second threaded portion, the third member being rotatable about the adjustment axis so as to change an extent of engagement with the first and second threaded portions, the third member having actuation means enabling adjustable movement thereof;

wherein actuating rotation of the third member about the adjustment axis produces a linear movement of the second member which is equal to a number of rotations of the third member multiplied by a difference between the first and second pitches.

8. The machine according to claim 7, wherein the actuation means includes a manually gripable adjustment wheel fixed to the third member.

9. The machine according to claim 7, wherein the actuation means includes automatic means for performing the rotation in response to a signal from a sensor.

10. The machine according to claim 7, wherein the adjustment axis is coincident with the ram axis.

11. The machine according to claim 7, wherein the third member includes an elongated shaft having a coaxial bore, the third threaded portion is defined by an external periphery of the shaft, and the fourth threaded portion is defined by a wall of the bore.

12. The machine according to claim 11, wherein the first, second, third and fourth threaded portions are at least partly concentric.

13. The machine according to claim 7, wherein the drive member includes an extensible cylinder, and an end of the cylinder is connected by linkage between the ram and the adjustment mechanism.

* * * * *